US009627158B2

(12) United States Patent
Chang et al.

(10) Patent No.: US 9,627,158 B2
(45) Date of Patent: Apr. 18, 2017

(54) KEYBOARD KEY USING AN ASYMMETRIC SCISSOR-TYPE CONNECTING ELEMENT

(71) Applicant: Primax Electronics Ltd., Neihu, Taipei (TW)

(72) Inventors: Hsien-Tsan Chang, Taipei (TW); Tsu-Yi Chen, Taipei (TW)

(73) Assignee: PRIMAX ELECTRONICS LTD., Taipei (TW)

( * ) Notice: Subject to any disclaimer, the term of this patent is extended or adjusted under 35 U.S.C. 154(b) by 37 days.

(21) Appl. No.: 14/867,346

(22) Filed: Sep. 28, 2015

(65) Prior Publication Data

US 2016/0365205 A1 Dec. 15, 2016

(30) Foreign Application Priority Data

Jun. 12, 2015 (TW) ..... 104119081 A

(51) Int. Cl.
*H01H 13/70* (2006.01)
*H01H 13/7065* (2006.01)
*H01H 13/02* (2006.01)

(52) U.S. Cl.
CPC ..... *H01H 13/7065* (2013.01); *H01H 13/023* (2013.01); *H01H 2205/002* (2013.01); *H01H 2219/036* (2013.01)

(58) Field of Classification Search
CPC ..... H01H 3/125
USPC ..... 200/5 A, 344; 400/490, 496
See application file for complete search history.

(56) References Cited

U.S. PATENT DOCUMENTS 5,278,371 A * 1/1994 Watanabe ..... H01H 3/125 200/344
6,979,792 B1 * 12/2005 Tsai ..... H01H 3/125 200/17 R
7,714,245 B2 * 5/2010 Chi ..... H01H 3/122 200/344
8,957,337 B2 * 2/2015 Niu ..... H01H 3/125 200/344
8,975,547 B2 * 3/2015 Shen ..... H01H 3/125 200/344

* cited by examiner

*Primary Examiner* — Vanessa Girardi
(74) *Attorney, Agent, or Firm* — Kirton McConkie; Evan R. Witt

(57) ABSTRACT

A keyboard module includes a first key and a second key. The first key includes a first keycap and a first scissors-type connecting element. The first scissors-type connecting element includes a first outer frame and a first inner frame. The second key includes a second keycap and a second scissors-type connecting element. The second scissors-type connecting element includes a second outer frame and a second inner frame. The first outer frame, the first inner frame and the second inner frame have symmetrical structures. The second outer frame has an asymmetrical structure.

11 Claims, 7 Drawing Sheets

KEYBOARD KEY USING AN ASYMMETRIC SCISSOR-TYPE CONNECTING ELEMENT

FIELD OF THE INVENTION

The present invention relates to a keyboard module, and more particularly to a keyboard module with keycaps having different lengths.

BACKGROUND OF THE INVENTION

Generally, the widely-used peripheral input device of a computer system includes for example a mouse device, a keyboard device, a trackball device, or the like. Via the keyboard device, characters and symbols can be inputted into the computer system directly. As a consequence, most users and most manufacturers of input devices pay much attention to the development of keyboard devices. The keyboard devices are classified into two types, i.e. the keyboard devices for desktop computers and the keyboard modules for notebook computers.

FIG. 1 is a schematic top view illustrating the outer appearance of a conventional keyboard module. As shown in FIG. 1, there are plural first keys 11 and plural second keys 12 on a surface of the conventional keyboard module 1. In comparison with the first keys 11, each of the second keys 12 further comprises an indication lampshade 120. When the first key 11 or the second key 12 is depressed by the user's finger, a corresponding signal is generated to the computer. According to the signal, the computer executes the function corresponding to the depressed key. For example, the conventional keyboard module 1 is a keyboard device for a notebook computer, and one of the second keys 12 is a Caps Lock key.

Hereinafter, the inner structure of the conventional keyboard module will be illustrated with reference to FIG. 2. FIG. 2 is a schematic side view illustrating a portion of the conventional keyboard module. In addition to the first keys 11 and the second keys 12, the conventional keyboard module 1 further comprises a membrane switch circuit member 13, a bottom plate 14 and a light-emitting element 15. Firstly, the structures of the first keys 11 and the second keys 12 will be described. Each first key 11 comprises a first keycap 111, a first scissors-type connecting element 112 and a first elastic element 113. Each second key 12 comprises a second keycap 121, a second scissors-type connecting element 122 and a second elastic element 123. The first scissors-type connecting element 112 of the first key 11 is used for connecting the first keycap 111 and the bottom plate 14 and allowing the first keycap 111 to be moved upwardly or downwardly. The first elastic element 113 is penetrated through the first scissors-type connecting element 112. Moreover, both ends of the first elastic element 113 are contacted with the first keycap 111 and the membrane switch circuit member 13, respectively. The first scissors-type connecting element 112 has a symmetrical structure. That is, the structure of a first side (e.g., the left side) of the first scissors-type connecting element 112 and the structure of a second side (e.g., the right side) of the first scissors-type connecting element 112 are identical.

Each second key 12 comprises a second keycap 121, a second scissors-type connecting element 122 and a second elastic element 123. The second scissors-type connecting element 122 of the second key 12 is used for connecting the second keycap 121 and the bottom plate 14 and allowing the second keycap 121 to be moved upwardly or downwardly. The second elastic element 123 is penetrated through the second scissors-type connecting element 122. Moreover, both ends of the second elastic element 123 are contacted with the second keycap 121 and the membrane switch circuit member 13, respectively. The second scissors-type connecting element 122 also has a symmetrical structure. That is, the structure of a first side (e.g., the left side) of the second scissors-type connecting element 122 and the structure of a second side (e.g., the right side) of the second scissors-type connecting element 122 are identical.

The membrane switch circuit member 13 comprises an upper wiring board 131, a spacer layer 132, and a lower wiring board 133. The upper wiring board 131 has plural upper contacts 1311. The spacer layer 132 is disposed under the upper wiring board 131, and comprises plural perforations 1321 corresponding to the plural upper contacts 1311. The lower wiring board 133 is disposed under the spacer layer 132, and comprises plural lower contacts 1331 corresponding to the plural upper contacts 1311. The plural lower contacts 1331 and the plural upper contacts 1311 are collectively defined as plural key switches 134. When the first keycap 111 is depressed and moved downwardly to push the first elastic element 113, the corresponding key switch 134 is triggered. The way of depressing the second keycap 112 is similar to the way of depressing the first keycap 111, and is not redundantly described herein. As shown in FIG. 2, the light-emitting element 15 corresponds to the second key 12. For example, the light-emitting element 15 is disposed under the second keycap 121. The light-emitting element 15 emits a light beam and projecting the light beam to the indication lampshade 120. Consequently, an illuminating function is achieved.

However, since the keyboard module 1 has the light-emitting element 15 corresponding to the second key 12, the light-emitting element 15 is covered or sheltered by the second scissors-type connecting element 122. Consequently, the illuminating efficacy of the light-emitting element 15 is adversely affected by the second scissors-type connecting element 122. For solving this drawback, a smaller scissors-type connecting element is used for preventing the light-emitting element 15 from being sheltered. The illuminating efficacy of the light-emitting element 15 is not adversely affected by the smaller scissors-type connecting element. However, the smaller scissors-type connecting element cannot stably support the second keycap 121. When the second keycap 121 is depressed by the user, the second keycap 121 is synchronously moved with the smaller scissors-type connecting element. Since the movement of the second key is unstable, the hand feel of depressing the key is usually unsatisfied.

Therefore, there is a need of providing a keyboard module and keys with stabilized keycaps and enhanced illuminating efficiency.

SUMMARY OF THE INVENTION

An object of the present invention provides a keyboard module and keys with stabilized keycaps and enhanced illuminating efficiency.

In accordance with an aspect of the present invention, there is provided a keyboard module. The keyboard module includes a bottom plate, a first key and a second key. The first key is disposed on the bottom plate, and includes a first keycap and a first scissors-type connecting element. The first scissors-type connecting element is connected with the bottom plate and the first keycap, and includes a first outer frame and a first inner frame. The second key is disposed on the bottom plate, and includes a second keycap and a second scissors-type connecting element. The second scissors-type connecting element is connected with the bottom plate and the second keycap, and includes a second outer frame and a second inner frame. Moreover, the first outer frame of the first scissors-type connecting element is symmetrical, and the second outer frame of the second scissors-type connecting element is asymmetrical.

In accordance with another aspect of the present invention, there is provided a key. The key includes a bottom plate, a keycap, a scissors-type connecting element and a light-emitting element. The keycap is disposed over the bottom plate. The scissors-type connecting element is arranged between the bottom plate and the keycap. The bottom plate and the keycap are connected with each other through the scissors-type connecting element. The keycap is movable relative to the bottom plate through the scissors-type connecting element. The scissors-type connecting element includes an inner frame and an outer frame. The inner frame has a symmetric structure. The outer frame has an asymmetrical structure. The light-emitting element is disposed over or under the bottom plate, and located near the scissors-type connecting element. The light-emitting element emits a light beam to the keycap. The light-emitting element is not sheltered by the outer frame in response to the asymmetrical structure of the outer frame.

From the above descriptions, the present invention provides the keyboard module and the key. The second scissors-type connecting element of the keyboard module and the key has the asymmetrical structure. Since the eighth connection shaft of the second outer frame is longer, the contact area between the eighth connection shaft and the second keycap is increased. Consequently, the stability of supporting the second keycap by the second outer frame is increased. On the other hand, since the second outer frame has the extension part, the sidewall of the second frame has the curvy region. Consequently, the light-emitting element is located beside the second scissors-type connecting element, and the second scissors-type connecting element and the light-emitting element are not overlapped with each other. Since the light beam from the light-emitting element is not obstructed by the second scissors-type connecting element, the illuminating efficacy is satisfied. Moreover, since the structure of the first inner frame of the first scissors-type connecting element and the structure of the second inner frame of the second scissors-type connecting element are identical, the first inner frame and the second inner frame can be produced by the same mold. That is, in the process of manufacturing the keyboard module of the present invention, only one kind of mold for the inner frame is required. Since the inner frames for two kinds of scissors-type connecting elements are produced by using one kind of mold, the economic benefit is achieved.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

For solving the drawbacks of the conventional technologies, the present invention provides a keyboard module and a key.

Figure 1:
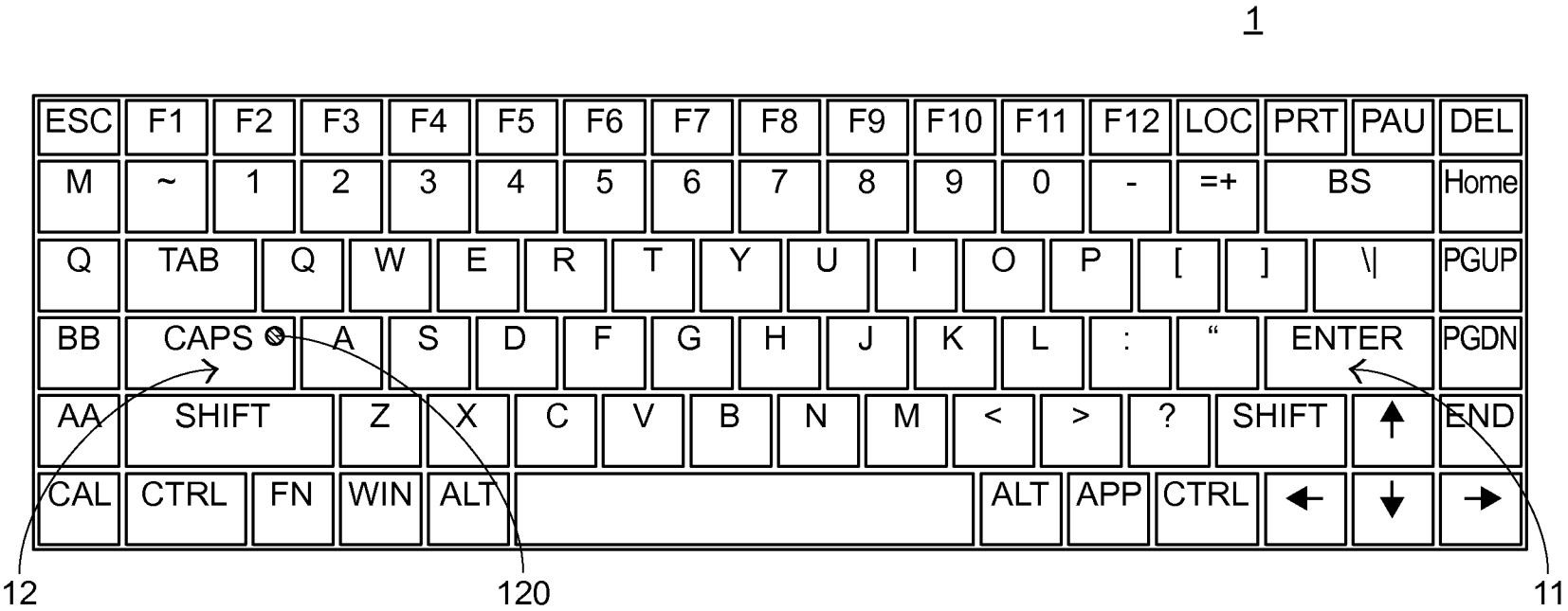
FIG.1 PRIOR ART
FIG. 1 is a schematic top view illustrating the outer appearance of a conventional keyboard module.
Figure 2:
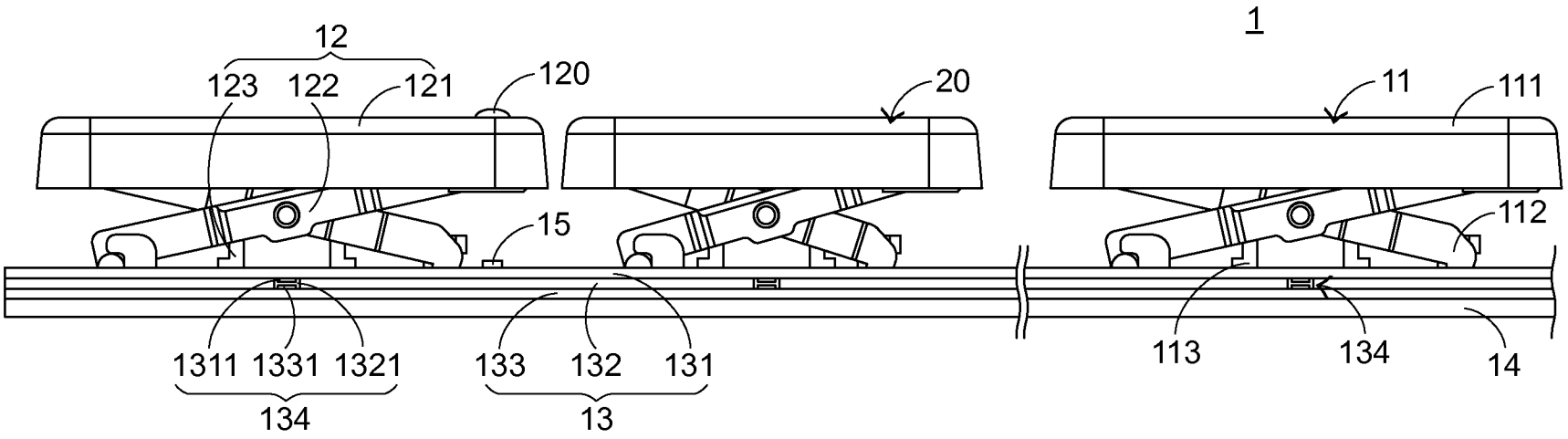
FIG.2 PRIOR ART
FIG. 2 is a schematic side view illustrating a portion of the conventional keyboard module.
Figure 3:
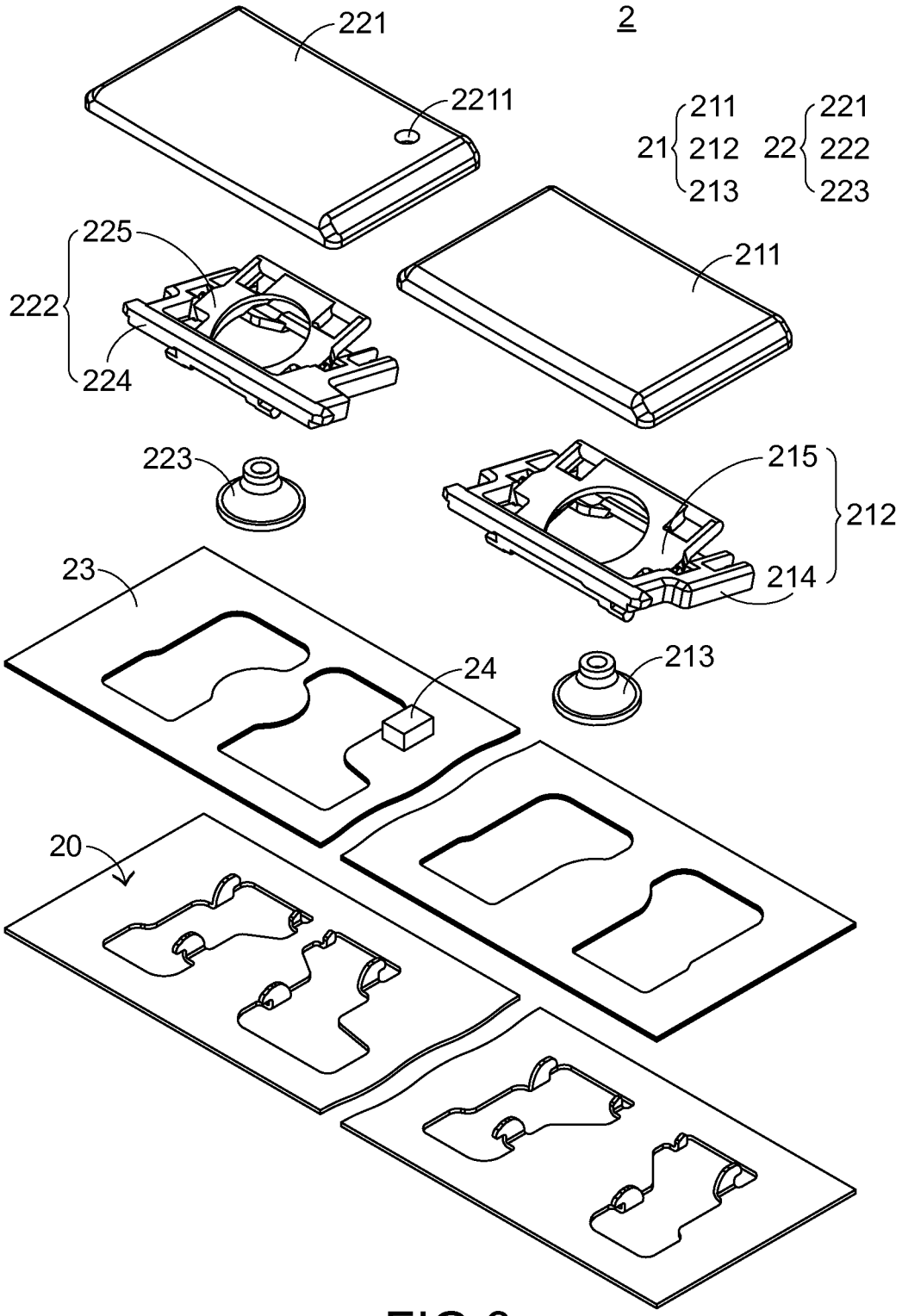
FIG. 3 is a schematic exploded view illustrating a keyboard module according to an embodiment of the present invention.

FIG. 3 is a schematic exploded view illustrating a keyboard module according to an embodiment of the present invention. As shown in FIG. 3, the keyboard module 2 comprises a bottom plate 20, a first key 21, a second key 22, a switch circuit board 23 and a light-emitting element 24.

The first key 21 is disposed on the bottom plate 20, and comprises a first keycap 211, a first scissors-type connecting element 212 and a first elastic element 213. The structure of the second key 22 is similar to the structure of the first key 21. The second key 22 is also disposed on the bottom plate 20, and comprises a second keycap 221, a second scissors-type connecting element 222 and a second elastic element 223. The second keycap 221 has an indication lampshade 2211. The switch circuit board 23 is disposed under the first elastic element 213 and the second elastic element 223. When the switch circuit board 23 is triggered by the first elastic element 213 or the second elastic element 223, a corresponding key signal is generated. The bottom plate 20 is disposed under the switch circuit board 23. The bottom plate 20 is used for supporting the first key 21, the second key 22, the switch circuit board 23 and the light-emitting element 24. The light-emitting element 24 is disposed on the switch circuit board 23. Moreover, the light-emitting element 24 is disposed under the second keycap 221 and aligned with the indication lampshade 2211. The light-emitting element 24 is used for emitting a light beam to the indication lampshade 2211 of the second keycap 221.

In an embodiment, the switch circuit board 23 is a membrane switch circuit board. The structure of the membrane switch circuit board is similar to that of the conventional membrane switch circuit board, and is not redundantly described herein. The light-emitting element 24 is a light emitting diode. The first elastic element 213 and the second elastic element 223 are rubbery elastomers. The first key 21 is a Tab key, and the second key 22 is a Caps Lock key.

Figure 4:
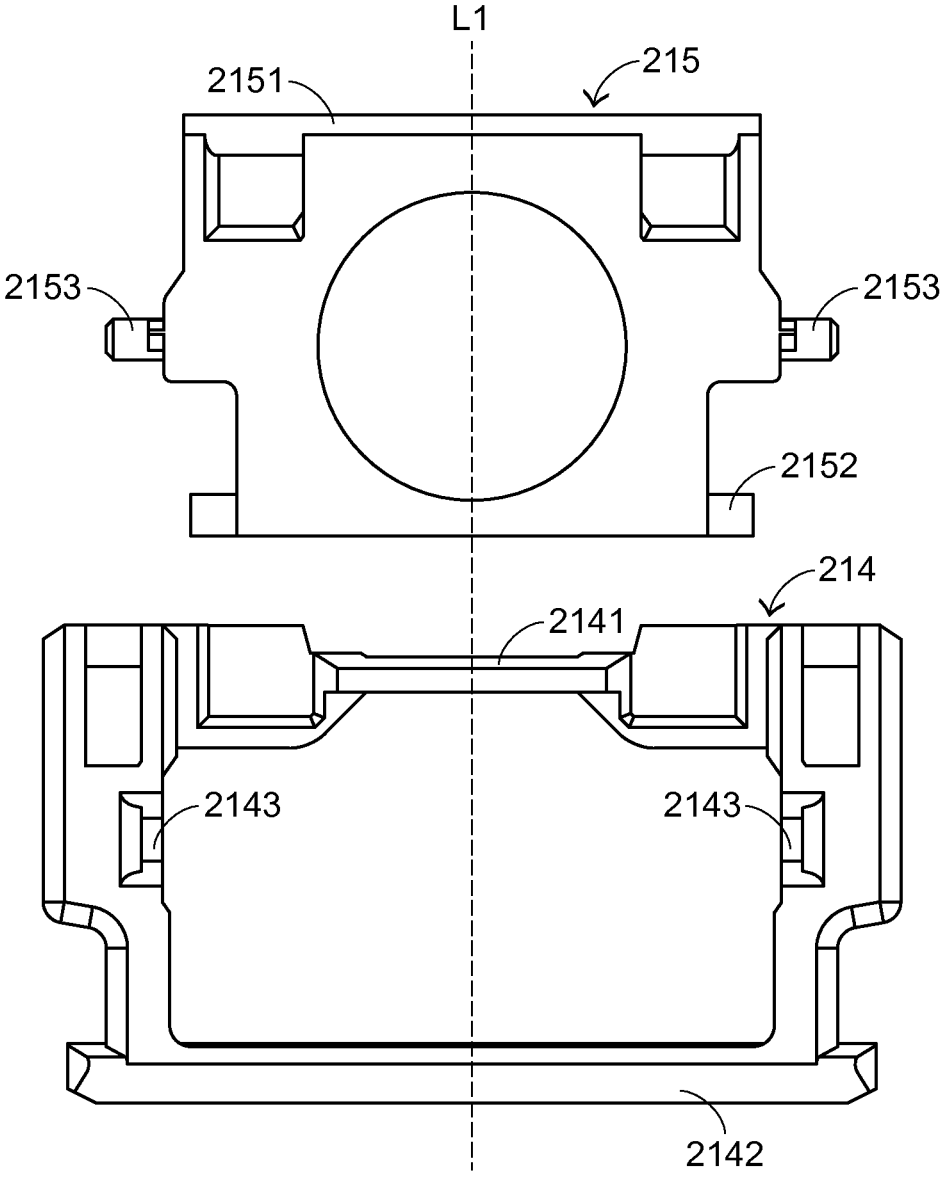
FIG. 4 is a schematic top view illustrating the first scissors-type connecting element of the keyboard module according to the embodiment of the present invention.

Please refer to FIGS. 3 and 4. FIG. 4 is a schematic top view illustrating the first scissors-type connecting element of the keyboard module according to the embodiment of the present invention. In FIG. 4, the structure of the first scissors-type connecting element 212 is shown. The first scissors-type connecting element 212 comprises a first outer frame 214 and a first inner frame 215. Both of the first outer frame 214 and the first inner frame 215 have symmetrical structures. The first inner frame 215 is disposed within the first outer frame 214, and connected with the bottom plate 20 and the first keycap 211. As the first inner frame 215 is swung relative to the first outer frame 214, the keycap 211 is moved relative to the bottom plate 20. In this embodiment, the first inner frame 215 comprises a first connection shaft 2151, a second connection shaft 2152 and plural first rotation shaft 2153. The first connection shaft 2151 is connected with the first connection shaft 2151. The second connection shaft 2152 is connected with the bottom plate 20. A first center line L1 passes through a center of the first connection shaft 2151 and a center of the second connection shaft 2152. As mentioned above, the first inner frame 215 has the symmetrical structure. In particular, a first half structure of the first inner frame 215 at a first side (e.g., the left side) of the first center line L1 and a second half structure of the first inner frame 215 at a second side (e.g., the right side) of the first center line L1 are symmetrical with respect to the first center line L1.

Figure 5:
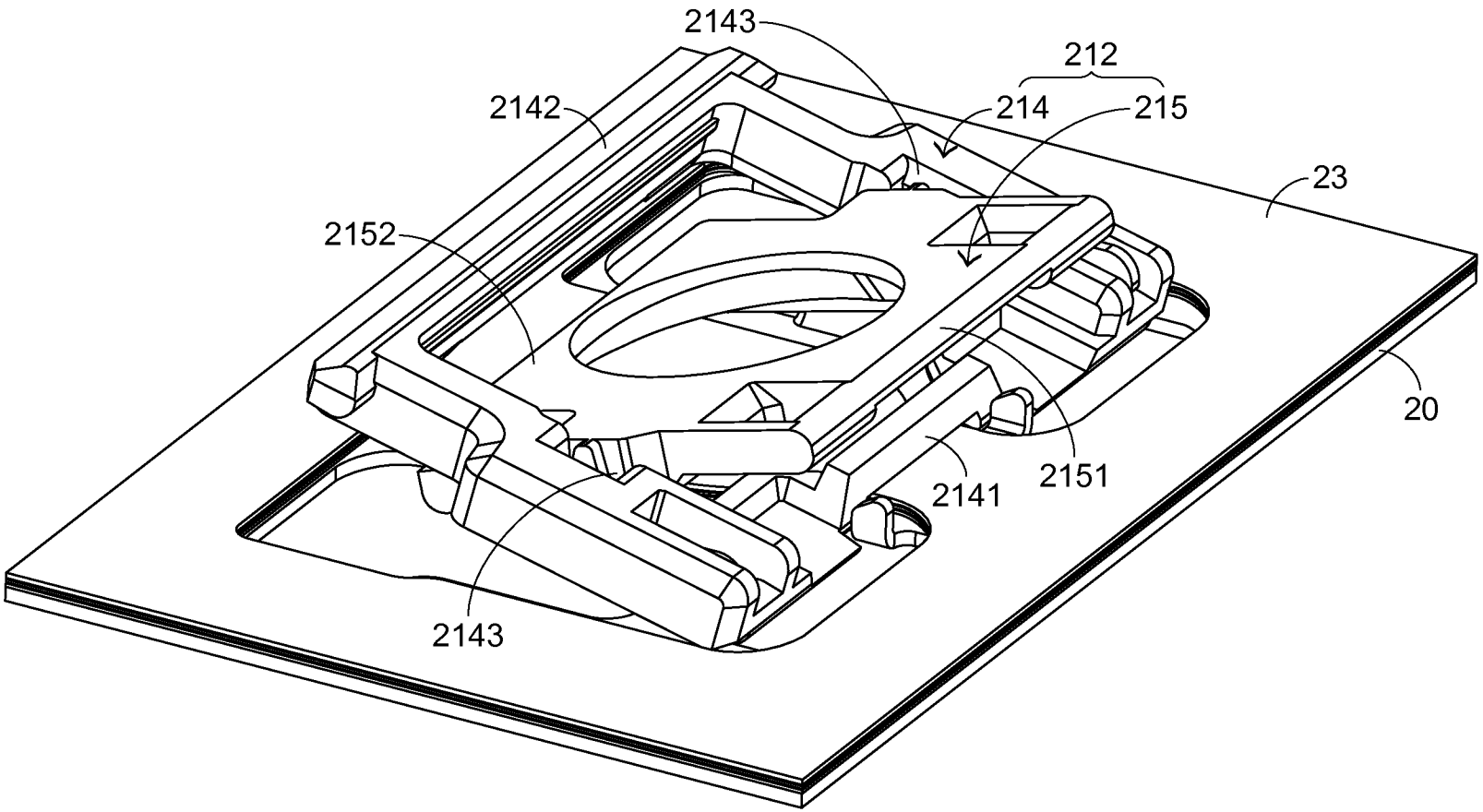
FIG. 5 is a schematic perspective view illustrating a portion of the first key of the keyboard module according to the embodiment of the present invention.

On the other hand, the first outer frame 214 comprises a third connection shaft 2141, a fourth connection shaft 2142 and plural first receiving recesses 2143. The third connection shaft 2141 is connected with the bottom plate 20. The fourth connection shaft 2142 is connected with the first keycap 211. The first receiving recesses 2143 correspond to respective first rotation shafts 2153 of the first inner frame 215. The first rotation shafts 2153 are accommodated within the corresponding first receiving recesses 2143. Consequently, the first inner frame 215 can be swung relative to the first outer frame 214 by using the first rotation shafts 2153 as fulcrums. In particular, a first half structure of the first outer frame 214 at the first side (e.g., the left side) of the first center line L1 and a second half structure of the first outer frame 214 at the second side (e.g., the right side) of the first center line L1 are symmetrical with respect to the first center line L1. The assembled structure of the first key 21 is shown in FIG. 5. Moreover, the first keycap 211 and the first elastic element 213 are not shown in FIG. 5 in order for clearly illustrating the structure of the first scissors-type connecting element 212.

The operations of depressing the first key 21 will be illustrated as follows. As shown in FIG. 5, the first key 21 is not depressed. Meanwhile, the first outer frame 214 and the first outer frame 215 are in an open-scissors state. When the first key 21 is depressed, a downward force is applied to the first keycap 21. In response to the downward force, the first elastic element 213 is pushed and in a compressed state. Moreover, in response to movement of the first keycap 211, the first inner frame 215 is rotated relative to the first rotation shafts 2153. Consequently, the first inner frame 215 is swung relative to the first outer frame 214. Under this circumstance, the first outer frame 214 is switched to a folded state. Moreover, the compressed first elastic element 213 touches the switch circuit board 23 to generate the corresponding signal.

Figure 6:
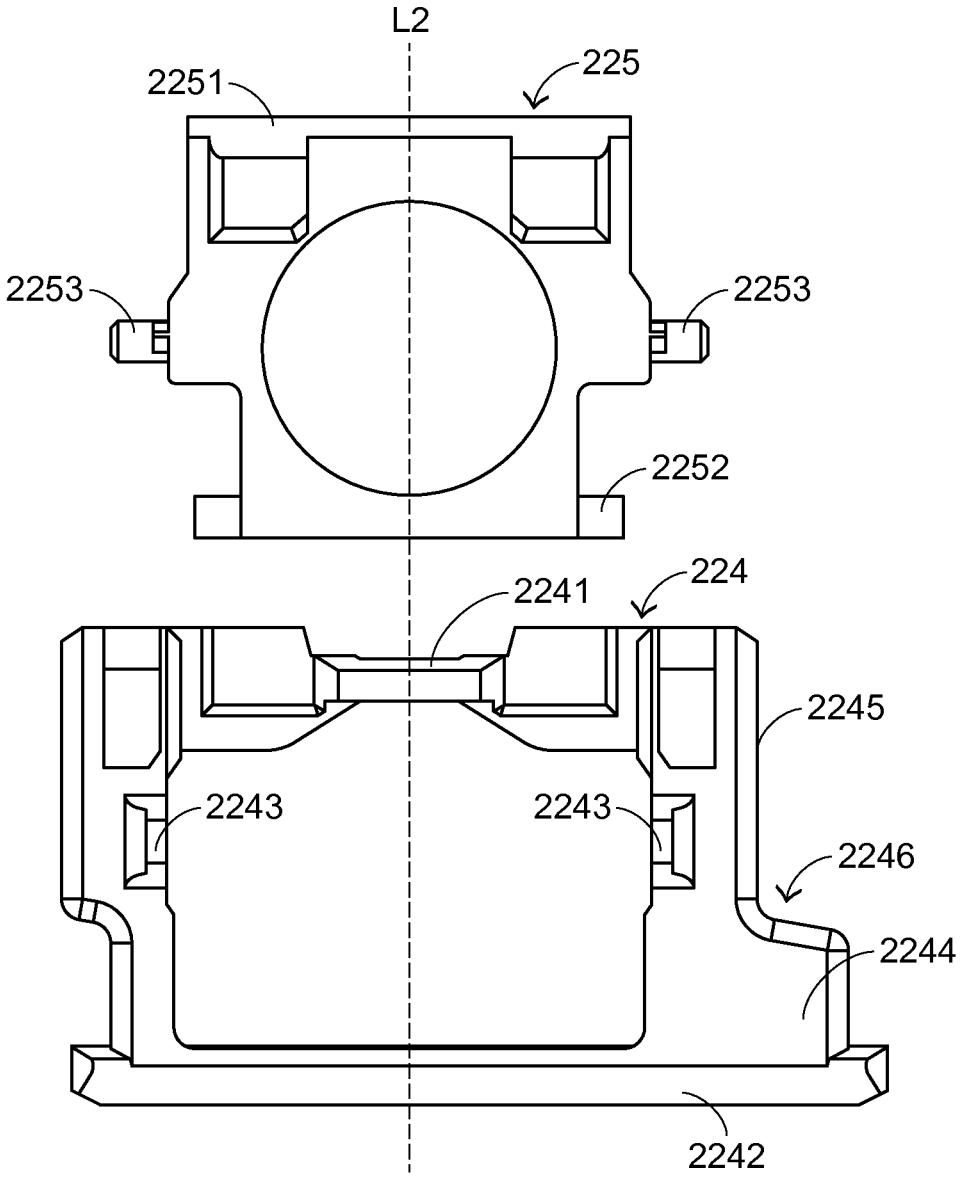
FIG. 6 is a schematic top view illustrating the second scissors-type connecting element of the keyboard module according to the embodiment of the present invention.
Figure 7:
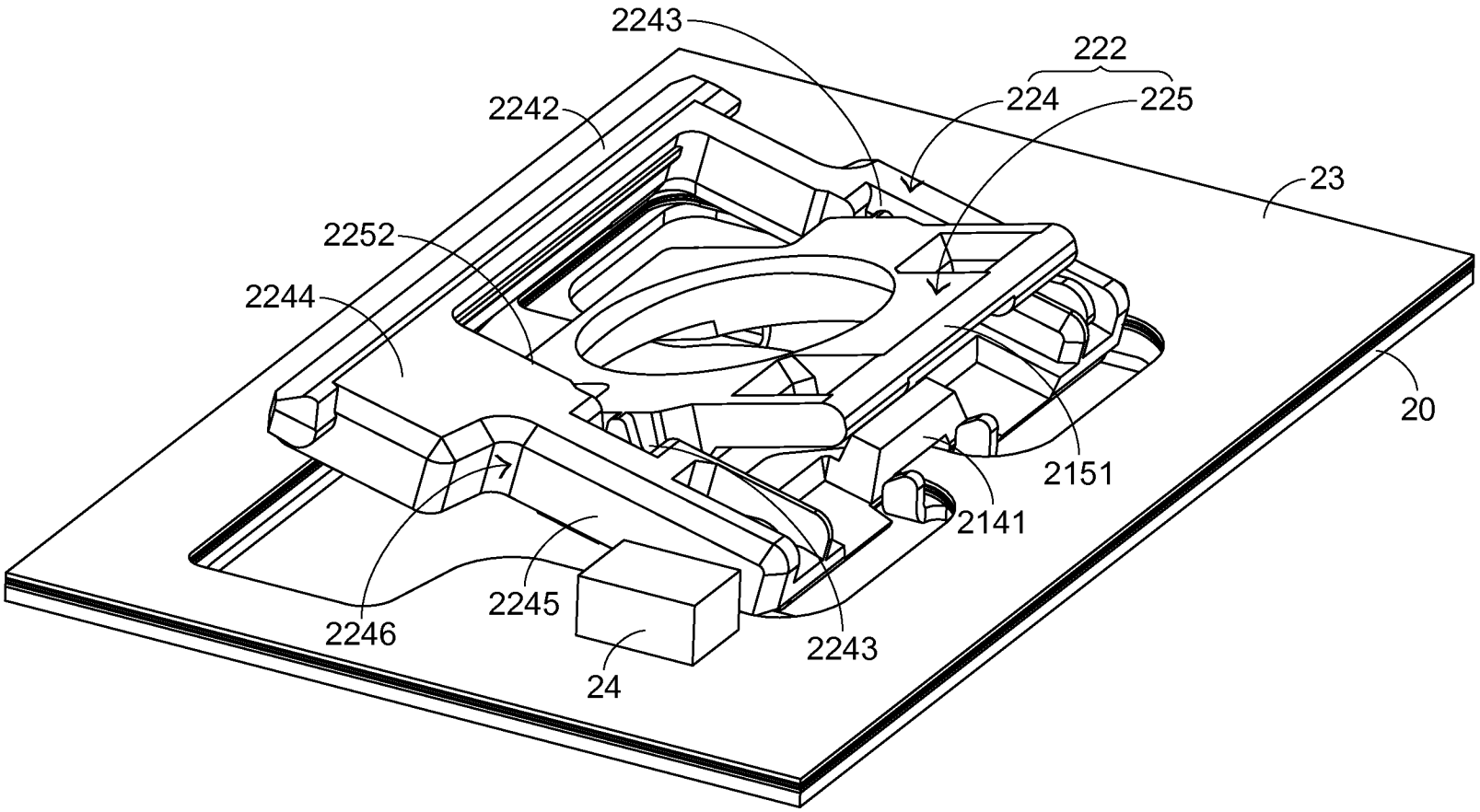
FIG. 7 is a schematic perspective view illustrating a portion of the second key of the keyboard module according to the embodiment of the present invention.

Please refer to FIGS. 3 and 6. FIG. 6 is a schematic top view illustrating the second scissors-type connecting element of the keyboard module according to the embodiment of the present invention. In FIG. 6, the structure of the second scissors-type connecting element 222 is shown. The second scissors-type connecting element 222 comprises a second outer frame 224 and a second inner frame 225. The second inner frame 225 has a symmetrical structure, but the second outer frame 224 has an asymmetrical structure. The second inner frame 225 is disposed within the second outer frame 224, and connected with the bottom plate 20 and the first keycap 211. As the second inner frame 225 is swung relative to the second outer frame 224, the second keycap 221 is moved relative to the bottom plate 20. In this embodiment, the second inner frame 225 comprises a fifth connection shaft 2251, a sixth connection shaft 2252 and plural second rotation shafts 2253. The sixth connection shaft 2252 is connected with the second keycap 221. The sixth connection shaft 2252 is connected with the bottom plate 20. A second center line L2 passes through a center of the fifth connection shaft 2251 and a center of the sixth connection shaft 2252. As mentioned above, the second inner frame 225 has the symmetrical structure. In particular, a first half structure of the second inner frame 225 at a first side (e.g., the left side) of the second center line L2 and a second half structure of the second inner frame 225 at a second side (e.g., the right side) of the second center line L2 are symmetrical with respect to the second center line L2.

As shown in FIG. 6, the second outer frame 224 comprises a seventh connection shaft 2241, an eighth connection shaft 2242, plural second receiving recesses 2243 and an extension part 2244. The seventh connection shaft 2241 is connected with the bottom plate 20. The eighth connection shaft 2242 is connected with the second key 221. The second receiving recesses 243 correspond to respective second rotation shafts 253 of the second inner frame 225. The second rotation shafts 2253 are accommodated within the corresponding second receiving recesses 2243. Consequently, the second inner frame 225 can be swung relative to the second outer frame 224 by using the second rotation shafts 2253 as fulcrums. The extension part 2244 is externally extended from a sidewall 2245 of the second outer frame 224. Due to the extension part 2244, the second outer frame 224 has the asymmetrical structure. Since the second outer frame 224 has the asymmetrical structure, the first half structure of the second outer frame 224 at the first side (e.g., the left side) of the second center line L2 and the second half structure of the second outer frame 224 at the second side (e.g., the right side) of the second center line L2 are asymmetrical with respect to the second center line L2.

The assembled structure of the second key 22 is shown in FIG. 6. Moreover, the second keycap 212 and the second elastic element 223 are not shown in FIG. 6 in order for clearly illustrating the structure of the second scissors-type connecting element 222. Moreover, due to the extension part 2244, the sidewall 2245 of the second outer frame 224 has a curvy region 2246. That is, the second outer frame 224 has a concave part (i.e., the curvy region 2246). Because of the curvy region 2246, the light-emitting element 24 is located beside the second scissors-type connecting element 222. That is, the light-emitting element 24 is not sheltered by the second scissors-type connecting element 222, and the projecting path of the light beam from the light-emitting element 24 is not obstructed by the second scissors-type connecting element 222. The operations of depressing the second key 22 are similar to the operations of depressing the first key 21, and are not redundantly described herein.

According to the comparison between the first key 21 and the second key 22, it is found that the length of the first keycap 211 is equal to the length of the second key 221, the first inner frame 215 and the second inner frame 225 have the same structures, and the first elastic element 213 and the second elastic element 223 have the same structures 223. The first key 21 and the second key 22 are distinguished by the following two aspects. Firstly, the second keycap 221 has the indication lampshade 2211, but the first keycap 211 does not have the lampshade. Secondly, the first outer frame 214 is symmetrical, but the second outer frame 224 is asymmetrical. In addition, the eighth connection shaft 2242 of the second outer frame 224 is longer than the fourth connection shaft 2142 of the first outer frame 214. Since the eighth connection shaft 2242 is longer than the fourth connection shaft 2142, the contact area between the eighth connection shaft 2242 and the second keycap 221 is larger than the contact area between the fourth connection shaft 2142 and the first keycap 211. Consequently, the stability of supporting the second keycap 221 by the second scissors-type connecting element 222 is increased, and the hand feel of depressing the key is enhanced.

From the above descriptions, the present invention provides the keyboard module and the key. The second scissors-type connecting element of the keyboard module and the key has the asymmetrical structure. Since the eighth connection shaft of the second outer frame is longer, the contact area between the eighth connection shaft and the second keycap is increased. Consequently, the stability of supporting the second keycap by the second outer frame is increased. On the other hand, since the second outer frame has the extension part, the sidewall of the second frame has the curvy region. Consequently, the light-emitting element is located beside the second scissors-type connecting element, and the second scissors-type connecting element and the light-emitting element are not overlapped with each other. Since the light beam from the light-emitting element is not obstructed by the second scissors-type connecting element, the illuminating efficacy is satisfied. Moreover, since the structure of the first inner frame of the first scissors-type connecting element and the structure of the second inner frame of the second scissors-type connecting element are identical, the first inner frame and the second inner frame can be produced by the same mold. That is, in the process of manufacturing the keyboard module of the present invention, only one kind of mold for the inner frame is required. Since the inner frames for two kinds of scissors-type connecting elements are produced by using one kind of mold, the economic benefit is achieved.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all such modifications and similar structures.

What is claimed is:

1. A keyboard module, comprising:

a bottom plate;

a first key disposed on the bottom plate, and comprising a first keycap and a first scissors-type connecting element, wherein the first scissors-type connecting element is connected with the bottom plate and the first keycap, and comprises a first outer frame and a first inner frame; and a second key disposed on the bottom plate, and comprising a second keycap and a second scissors-type connecting element, wherein the second scissors-type connecting element is connected with the bottom plate and the second keycap, and comprises a second outer frame and a second inner frame, wherein the first outer frame of the first scissors-type connecting element is symmetrical, and the second outer frame of the second scissors-type connecting element is asymmetrical.

2. The keyboard module according to claim 1, wherein the first inner frame of the first scissors-type connecting element is disposed within the first outer frame, and connected with the bottom plate and the first keycap, wherein as the first inner frame is swung relative to the first outer frame, the first keycap is moved relative to the bottom plate, wherein the first inner frame is symmetrical, and the first inner frame comprises:

a first connection shaft connected with the first keycap; and a second connection shaft connected with the bottom plate, wherein a first center line passes through a center of the first connection shaft and a center of the second connection shaft, wherein a first half structure of the first inner frame at a first side of the first center line and a second half structure of the first inner frame at a second side of the first center line are symmetrical with respect to the first center line.

3. The keyboard module according to claim 2, wherein the first outer frame comprises:

a third connection shaft connected with the bottom plate; and a fourth connection shaft connected with the first keycap, wherein a first half structure of the first outer frame at the first side of the first center line and a second half structure of the first outer frame at the second side of the first center line are symmetrical with respect to the first center line.

4. The keyboard module according to claim 1, wherein the second inner frame of the second scissors-type connecting element is disposed within the second outer frame, and connected with the bottom plate and the second keycap, wherein as the second inner frame is swung relative to the second outer frame, the second keycap is moved relative to the bottom plate, wherein the second inner frame is symmetrical, and the second inner frame comprises:

a fifth connection shaft connected with the second keycap; and a sixth connection shaft connected with the bottom plate, wherein a second center line passes through a center of the fifth connection shaft and a center of the sixth connection shaft, wherein a first half structure of the second inner frame at a first side of the second center line and a second half structure of the second inner frame at a second side of the second center line are symmetrical with respect to the second center line.

5. The keyboard module according to claim 4, wherein the second outer frame comprises:

a seventh connection shaft connected with the bottom plate; and an eighth connection shaft connected with the second keycap, wherein a first half structure of the second outer frame at the first side of the second center line and a second half structure of the second outer frame at the second side of the second center line are asymmetrical with respect to the second center line.

6. The keyboard module according to claim 5, wherein the second outer frame further comprises an extension part, wherein the extension part is externally extended from a sidewall of the second outer frame, so that the second outer frame is asymmetrical, wherein the eighth connection shaft is longer than a fourth connection shaft of the first outer frame.

7. The keyboard module according to claim 6, further comprising a light-emitting element, wherein the light-emitting element is disposed under the second keycap and emits a light beam to the second keycap, wherein the sidewall of the second outer frame has a curvy region in response to the extension part, so that the light-emitting element is not sheltered by the second scissors-type connecting element.

8. A key, comprising:

a bottom plate;

a keycap disposed over the bottom plate;

a scissors-type connecting element arranged between the bottom plate and the keycap, wherein the bottom plate and the keycap are connected with each other through the scissors-type connecting element, and the keycap is movable relative to the bottom plate through the scissors-type connecting element, wherein the scissors-type connecting element comprises an inner frame and an outer frame, wherein the inner frame has a symmetric structure, and the outer frame has an asymmetrical structure; and a light-emitting element disposed over or under the bottom plate, and located near the scissors-type connecting element, wherein the light-emitting element emits a light beam to the keycap, wherein the light-emitting element is not sheltered by the outer frame in response to the asymmetrical structure of the outer frame.

9. The key according to claim 8, wherein the inner frame is disposed within the outer frame, and connected with the bottom plate and the keycap, wherein as the inner frame is swung relative to the outer frame, the keycap is moved relative to the bottom plate, wherein the inner frame comprises:

a first connection shaft connected with the keycap; and a second connection shaft connected with the bottom plate, wherein a center line passes through a center of the first connection shaft and a center of the second connection shaft, wherein a first half structure of the inner frame at a first side of the center line and a second half structure of the inner frame at a second side of the center line are symmetrical with respect to the center line.

10. The key according to claim 9, wherein the outer frame comprises:

a third connection shaft connected with the bottom plate; and a fourth connection shaft connected with the keycap, wherein a first half structure of the outer frame at the first side of the center line and a second half structure of the outer frame at the second side of the center line are asymmetrical with respect to the center line.

11. The key according to claim 10, wherein the outer frame further comprises an extension part, wherein the extension part is externally extended from a sidewall of the outer frame, so that the outer frame has the asymmetrical structure, wherein the sidewall of the outer frame has a curvy region in response to the extension part, so that the light-emitting element is not sheltered by the outer frame.

* * * * *